United States Patent [19]

Joensson et al.

[11] 3,937,114

[45] Feb. 10, 1976

[54] APPARATUS FOR CUTTING LOGS

[75] Inventors: Karl-Erik Joensson, Pierre Fond, Canada; Hakan Nordquist, Decatur, Ga.

[73] Assignee: Mo och Domsjo Aktiebolag, Ornskoldsvik, Sweden

[22] Filed: Nov. 19, 1974

[21] Appl. No.: 525,127

[30] Foreign Application Priority Data

Nov. 22, 1973 Sweden ..... 7315844

[52] U.S. Cl. ..... 83/425.2; 144/312; 83/158

[51] Int. Cl.[2] ..... B27B 5/04

[58] Field of Search ..... 83/425.2, 158; 144/312

[56] References Cited

UNITED STATES PATENTS

| | | | |
|---|---|---|---|
| 1,894,415 | 1/1933 | Onstad | 83/425.2 |
| 2,881,811 | 4/1959 | Haumann | 83/425.2 |
| 3,812,951 | 5/1974 | Fullaway | 83/158 |

*Primary Examiner*—Donald R. Schran

[57] ABSTRACT

An apparatus is provided for cutting lengths of debranched trees or logs into shorter pieces, comprising a conveyor for carrying the logs sideways to and past a plurality of cutters arranged in groups, the cutters in each group being individually movable between active cutting and inactive noncutting positions, and into cutting positions over a determined span, and spaced apart along the path of travel of the logs so that only one cutter at a time in a given group cuts a log. Beyond the cutters, a means is provided for classifying the logs according to quality and dimensions, and then separating the classified logs for further cutting into lumber, pulping, or other processing, according to the use to which the log can be put.

12 Claims, 7 Drawing Figures

(V - V)

APPARATUS FOR CUTTING LOGS

The mechanization of the timber industry has now proceeded to the point where it is no longer customary to cut up trees in the field, but instead to strip the trees of their branches and then convey the remainder, either in its entirety or in several smaller pieces, to cutting apparatus which is capable of cross-cutting the lengths into shorter logs, suitable for further processing in a saw mill, or for pulping, or for chipping, or for other purposes. Such apparatus is capable of handling sideways rather long lengths of tree trunk, and even entire trees.

It is of course apparent that the diameter of a tree trunk and also the quality of the wood in a given tree varies along its length, and it is therefore necessary to cut the tree into selected lengths, so as to separate those log portions which are best suited for sawing into planks, or lumber, from pieces not so suitable but processable into pulp, or chips for the manufacture of chipboard, or in other ways. This means that in the course of a cutting process it is necessary to evaluate the tree not once, but several times, so that the tree can first be cut appropriately into logs, and then appropriately sorted according to end use.

Cutting apparatus of this type normally includes a rather wide conveyor, which is capable of conveying long trees or lengths of tree sideways, and a long straight row of cutters arranged across the conveyor transversely to the sideways movement of the logs. The cutters can be moved across the width of the conveyor to a limited extent, according to the position of the adjacent cutters on either side, and the cutters can also be moved between active cutting and inactive noncutting positions. Before a given length of tree can be cut into logs, it is necessary first to position the cutters according to the lengths of log desired, move the cutters from an inactive to an active cutting position, and then carry out the cutting. The three separate operations have to be carried out in sequence, which makes it virtually impossible to carry out the cutting operation continuously. In fact, these operations slow it down considerably, with a resulting low production capacity for the cutting apparatus.

When the cutters are arranged side by side in a long straight row, several cutters are usually in cutting engagement with a given length of tree at the same time. This poses difficulties, because since a tree trunk varies in diameter, the cutters along the length of tree encounter different stresses during cutting. As a result, the rate of cutting may vary, and such variations may throw the tree askew, decreasing the cutting speed of the cutters, and also increasing the possibility of a cutter wedging or jamming in the cut.

It is also difficult, when the cutters are arranged in a straight row, to move adjacent cutters sufficiently close to each other to cut out selected sections of trunk, because the motor and the supporting bracket take up space, and are in the way. This imposes limits on the selection of the best locations for the cuts.

In accordance with the present invention, a cutting apparatus is provided in which these difficulties are overcome by arranging the cutters in groups, with the cutters of each group acting over a determined span and offset with respect to each other, so that they are either in different rows in that span or at least sufficiently spaced along the length of the conveyor that only one cutter at a time in a given group is in engagement with the log. Thus, the cutting apparatus of the present invention provides not one but two or more cutting stages. By thus offsetting the cutters in a group, the cutters can be placed at any close or distant spacing with respect to each other, so that there are no limits on the selection of cutting positions along the log or tree length. Moreover, by judiciously engaging selected cutters with the tree or log in stages, cutters can be arranged to cut together that encounter similar cutting stresses, so that the risk of throwing the tree or log askew during cutting is reduced. The rate of production is also increased, because while one set of cutters is doing the cutting, the following set of cutters can be being positioned, thus reducing the time required for positioning the cutters, and spacing the cutters in the second stage while the cutting in the first stage is actually taking place. The result, although the cutting is now in several stages rather than in one, is an actual saving in time, and an increase in rate of production.

The apparatus in accordance with the invention accordingly comprises, in combination, a conveyor for carrying lengths of trees or logs sideways to and through a cutter; a cutter extending across the conveyor and comprising a plurality of cutting means movable between inactive noncutting and active cutting positions and between limiting positions along the length of a tree or log for cross-cutting the length at a selected position, the cutting means being arranged in groups and spread lengthwise in such groups along the length of the conveyor a distance such that only one cutting means in a group is in cutting engagement with a given length of tree or log one at a time; means for arranging selected cutting means across the conveyor according to the selected cuts to be made in a length of tree or log, and means for collecting and delivering cut log pieces according to the desired end use.

The apparatus of the invention may further include means for either automatically or visually determining the quality and dimensions of lengths of tree or log, to determine what log pieces are to be cut out and where, for optimum utilization of the tree or log, and means for classifying the log pieces according to quality and dimensions, selecting the end use to which the log pieces are to be put, and for directing the cut log pieces as appropriate for sawing, pulping, chipping or other purposes.

The apparatus may also include additional conveyors for carrying the cut log pieces from the cutters to the classifying means and the sorter. One or more inclined feed conveyors may be included before the cutters, for separating bundles or piles of the tree lengths into single lengths, and conveying the lengths one at a time to the cutters.

The drawings represent preferred embodiments of the invention, in which:

FIG. 1 is a side view of the cutter feed conveyor and cutter sections of apparatus in accordance with the invention, having a pair of inclined conveyors which break up and distribute lengths of tree one at a time to the cutters, and a plurality of cutters arranged in groups and spaced lengthwise as well as transversely of the conveyor, and conveyors for carrying the cut log pieces to the log classifying and sorting stage;

Figure 1:
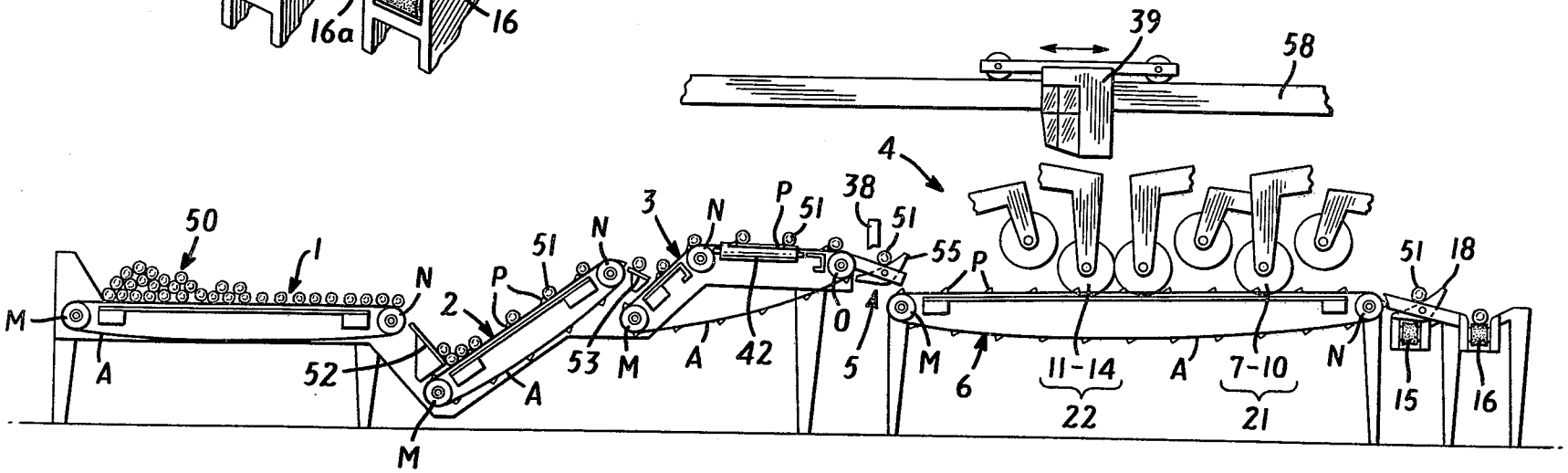
Figure 2:
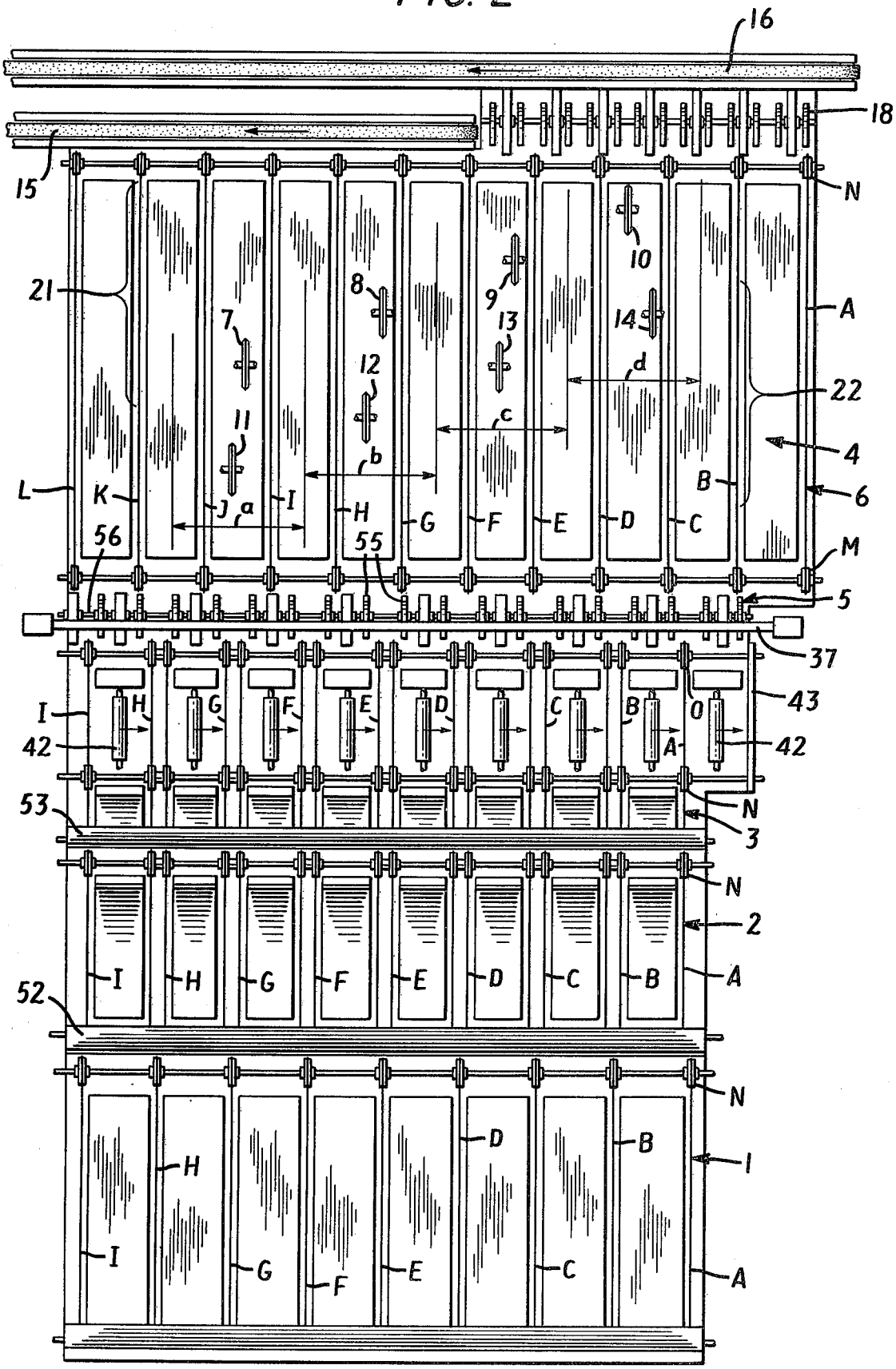
FIG. 2 is a plan view of the cutter feed and cutter portion of the apparatus shown in FIG. 1.

The apparatus of FIGS. 1 to 6 is arranged to process tree lengths or trunks into logs by moving them from left to right, in FIG. 1, and from bottom to top in FIG. 2.

The apparatus shown in FIGS. 1 to 6 is composed of a first feed conveyor 1 which is laid out horizontally and receives at the starting end A bundles or piles 50 of tree lengths to be graded, cut and sorted. The lengths or trunks are placed transversely on the conveyor 1 using, for example a fork lift truck. Directly following the first feed conveyor 1 are second and third feed conveyors 2, 3, which are inclined with respect to the horizontal conveyor 1.

The conveyors 1, 2, 3 each comprise a plurality of endless chains A, B, C, D, E, F, G. H, I (see FIG. 2); each chain is carried on two or more sprockets M, N, O, and rotated endlessly so as to move the tree lengths forward towards the cutters. The chains of conveyors 2, 3 also comprise a plurality of carriers P, to ensure that the tree lengths are carried forward with the chains towards the cutters.

The conveyors 2, 3 are set at an angle to the horizontal, in contrast to the horizontally arranged conveyor 1, so as to break up the log bundles or groups 50 carried forward on the conveyor 1 and deliver the lengths 51 one at a time to the cutters 4. The conveyor 2 is at an angle of 40° to the horizontal. The first portion of conveyor 3 is at an angle of 45° to the horizontal, but the major portion of the conveyor following this inclined portion extends horizontally.

The angles at which the conveyors 2, 3 are placed to the horizontal can however be widely varied, and a suitable range is from about 35° to about 55°. Greater angles than 55° and lesser angles than 35° can of course be used. Angles within the ranges stated are the most efficient for breaking up jams and groups of tree lengths, and delivering them one at a time to the cutters 4.

A plurality of bridging members 52, 53 are provided between chains 1, 2 and 2, 3 so as to carry the lengths or logs easily from one conveyor to the next. Each of the conveyors 1, 2, 3 is operated by motors (not shown) in a manner such that the conveying speed of conveyor 3 is faster than conveyor 2, and conveyor 2 is faster than conveyor 1, so that the rate of travel of the lengths or logs increases from conveyor 1 to conveyor 2, and from conveyor 2 to conveyor 3. The result of the speed differentials and the inclination of the conveyors 2, 3 to the horizontal is a separation of the lengths or logs, so that only one length or log at a time is carried to the cutter 4.

Along the horizontal portion of the conveyor 3, between the endless chains A–I, are a plurality of roller conveyors 42, which are adapted to align the butt ends of the logs according to the fixedly attached drive plate 43. This alignment takes place while the logs are being carried forward by the conveyor 3.

At the end of the conveyor 3 is a one-piece feeder 5 (see FIG. 4), which feeds the logs one at a time to the cutters. The feeder 5 comprises a plurality of pivotable arcuate carriers 55, carried on a shaft 56, and arranged for pivoting by hydraulic cylinder 57. Only one tree length at a time fits on the carriers 55, and the cylinder 57 tips the carriers so as to dump a tree length thereon on the conveyor 6. The feeder 5 slows the travel speed of the logs, and while they are held thereon, the dimensions and quality of the lengths are determined, either visually, by an operator in control cab 39, moving on track 58 alongside and/or above the conveyors 1, 2, 3, 6, or automatically, by conventional means. The resulting information can be fed to a computer, to determine the correct locations for the cuts.

The cutters 7 to 14 are located above the long chain conveyor 6, inclined upwardly, at an angle of several degrees to the horizontal, in this instance 2°, but optionally extending up to approximately 10°, to position the lengths of tree or logs 51 against the pushers P on the endless chains A–L of the conveyor 6. The chains A–L run about the sprockets M, N and are operated by a motor (not shown) in a manner to convey the lengths forward. The pusher members P ensure that the lengths of tree or logs 51 are held securely and carried forward during the cutting, up the slight incline.

Arranged above the conveyor 6 are a plurality of cutters or cutter assemblies 7 to 14, distributed in pairs or groups in two rows 21, 22, so that there are two cutters per group for each transverse section *a*, *b*, *c*, *d*, of the conveyor 6, one in each row. Arranged in four pairs, 7, 11; 8, 12; 9, 13; and 10, 14; which pairs are offset with respect to each other in each group, th four cutters 7, 8, 9, 10 constitute the rear row 21, and the cutters 11, 12, 13, 14 constitute the front row 22. These cutters are adapted to cut the lengths of tree or logs into log sections, according to the established dimensions and quality of the logs. Each pair of cutters 7, 11; 8, 12; 9, 13; and 10, 14; can be moved transversely across the conveyor along the lengths or logs over a span indicated as *a*, *b*, *c* and *d*, respectively, on FIG. 2. The members of each cutter pair, 7, 11; 8, 12; 9, 13; and 10, 14; are also spaced longitudinally along the conveyor 6, so that only one cutter of each group at one time is in engagement with the length or log being cut. Each cutter can also be moved between an inactive noncutting position, raised above the conveyor 6, and an active cutting position, arranged to cut the lengths or logs being carried along the conveyor.

This arrangement has several advantages. First of all, the cutters of each group can be moved transversely in such a manner that cuts across the length or log can be made as close as desired. Moreover, two cutters are provided for each group over the spans *a*, *b*, *c*, *d*, which makes it possible to position one cutter in each group while the other one is cutting. In this way, time is saved, and a higher production rate can be achieved.

Moreover, by offsetting the pairs of cutters in each row and separating the cutters in each group so that only one cutter at a time in each group is brought into contact with the log, the cutters do not tend to get caught in the cuts of the logs or to throw the log askew, which makes it possible to maintain the rate of forward travel of the log during cutting, and prevent the cutters from jamming in the cuts during cutting.

Figure 5:
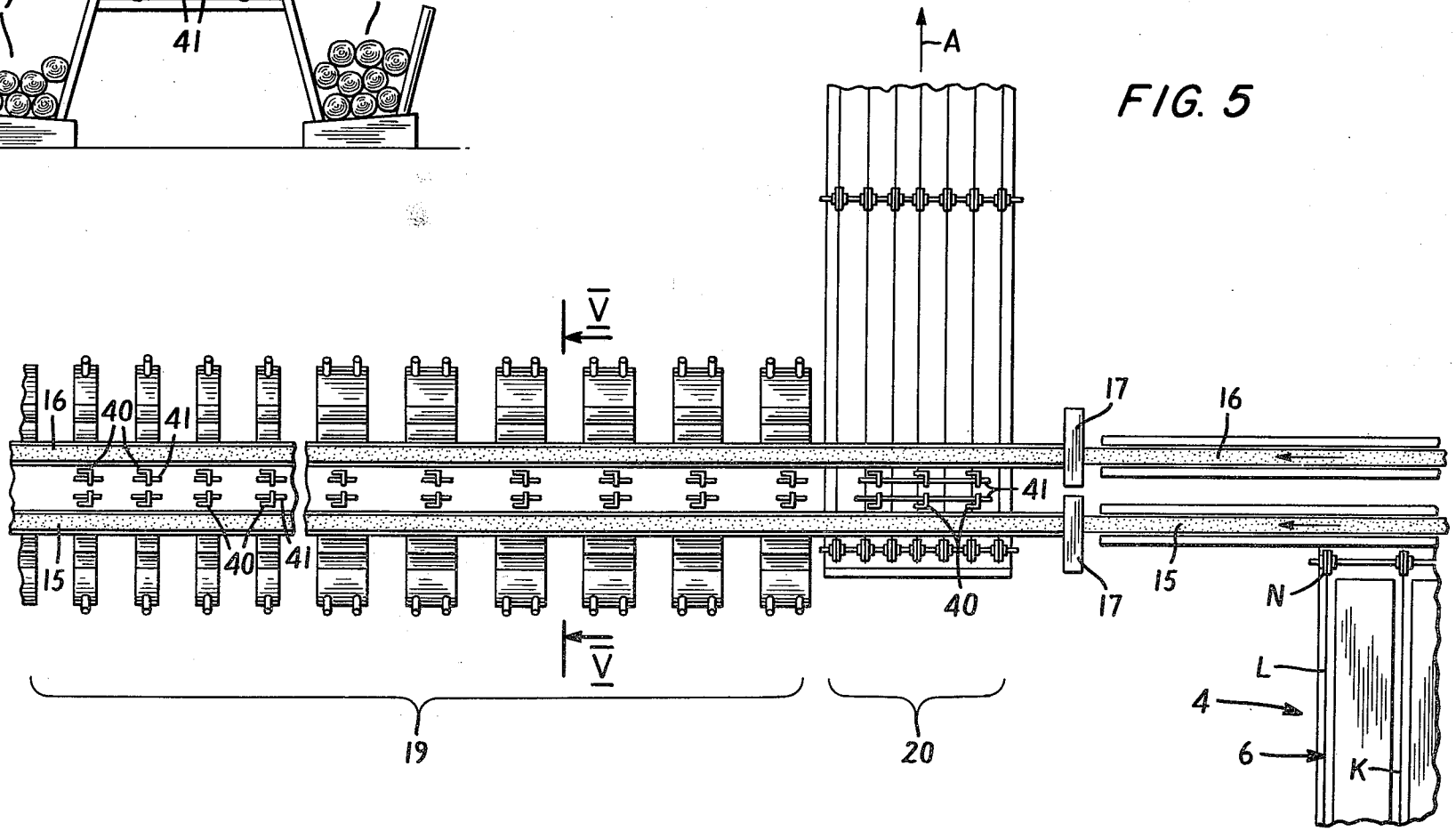
FIG. 5 is a plan view of the sorter of the apparatus of the invention, following in sequence that portion of the apparatus shown in FIGS. 1 and 2.

From the conveyor 6 the cut pieces of log are fed to one of two belt conveyors 15, 16, which move transversely with respect to the conveyor 6, as best seen in FIGS. 2 and 5. The conveyor 15 is shorter than the conveyor 16, and extends only part way across the end of conveyor 6. The cut log pieces are fed directly to the conveyor 15 but move to the conveyor 16 by jumping over the span of the conveyor 15 on a plurality of one-piece feeders 18, mounted between the conveyor 6 and the conveyor 16.

As seen in FIG. 5, each of the conveyors 15 and 16 carry the cut log pieces conveyed thereon past a sensing device 17, which is adapted to automatically sense the length and a predetermined number of diameters of the respective log pieces, and to compute further properties of the log pieces, such as, for instance, the volume and the taper. The sensed and computed values are used for determining how the logs are sorted, which follows next.

While carrying out this function, the sensing device 17 sends out a signal in response to particular sensed and computed values. The signal is received by the deflector 40, which determines which of a number of sorting bays 19 is to receive the particular cut piece, or whether the piece is to be conveyed by the conveyor 20 to a plant (not shown in the Figures) for pulping wood, indicated by the arrow in FIG. 5.

Figure 3:
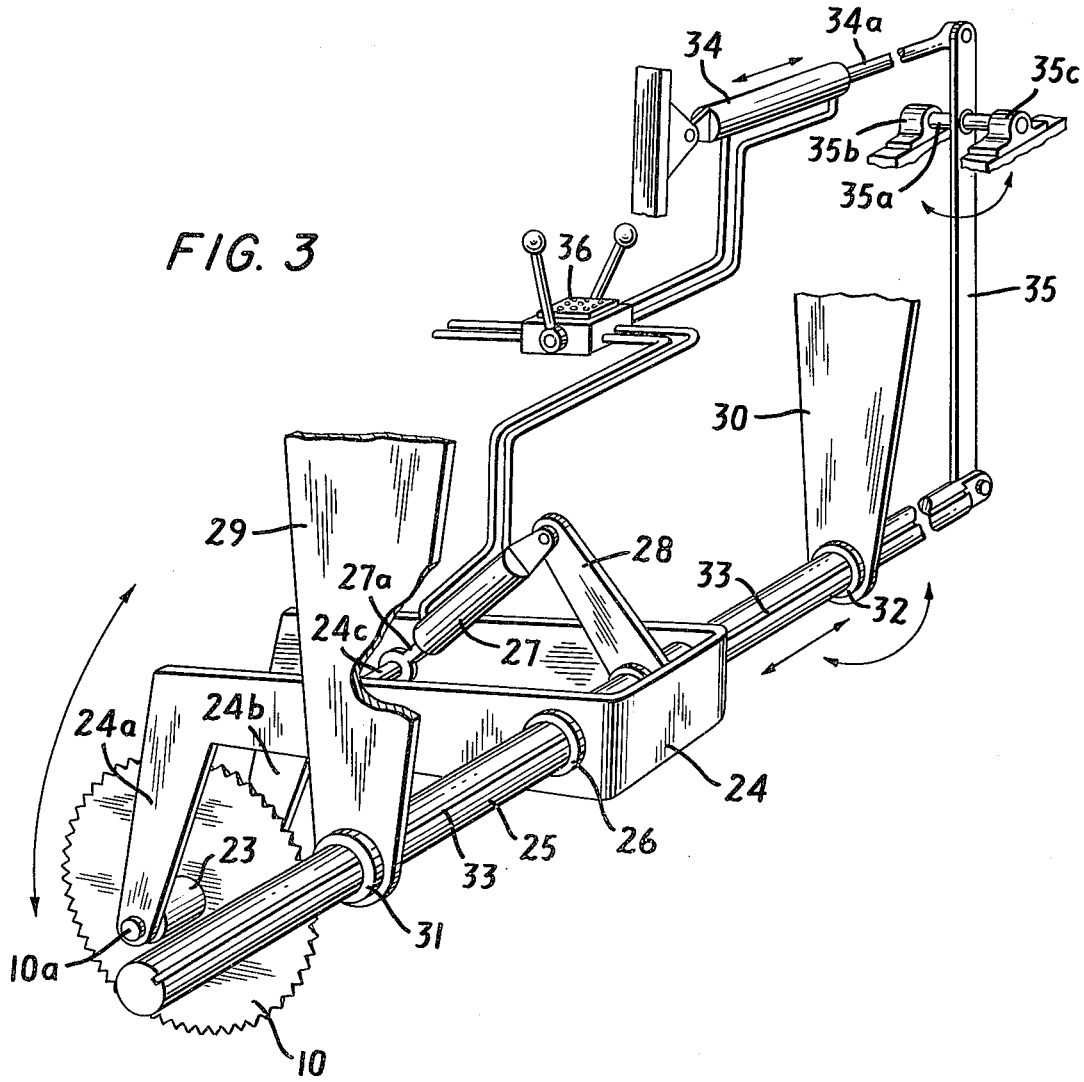
FIG. 3 is a detailed view of one of the cutters of FIG. 1, and its operating mechanism.
Figure 4:
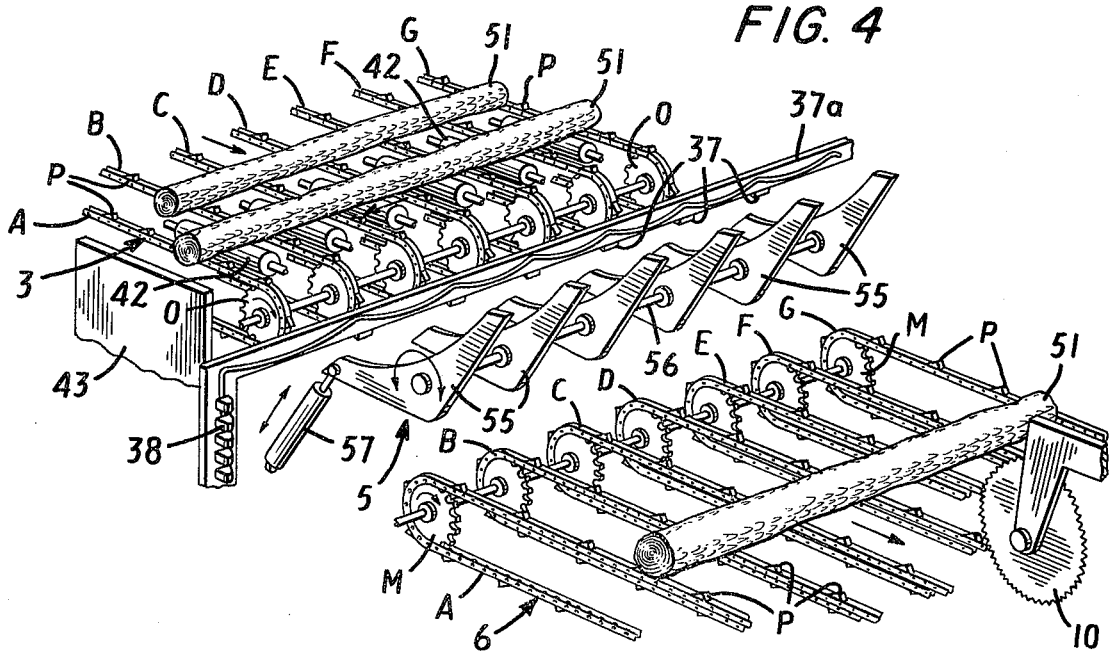
FIG. 4 is a detailed view of the dimension-determining device of the apparatus of FIG. 1.

As best seen in FIG. 3, each cutter assembly (in this case exemplified by cutter 10) comprises a power-driven circular saw 10 mounted on axle 10*a* for rotation at the ends of arms 24*a*, 24*b* of the U-shaped bracket 24, and operatively connected to the motors 23. The U-shaped bracket 24 in turn is pivotably mounted on the shaft 25, and fixed axially in position on the shaft by the stop sleeves 26, one on each side of the bracket 24 (the second stop sleeve is not shown). Thus, the saw 10 can be pivoted between a raised and inactive noncutting position above the conveyor 6 (the position shown in FIG. 3) or lowered to an active cutting position, as shown by the arrow in FIG. 3, for cutting a length or log as it is moved forward by the conveyor 6.

The movement of the cutter 10 between raised and lowered positions on the shaft 25 is effected by a hydraulic cylinder 27, which acts against a connecting bar 28 fixedly mounted on the shaft 25. Actuation of the hydraulic cylinder moves out the piston 27*a*, pivotably mounted on shaft 24*c* of bracket 24, and thus moves the cutter 10 downwardly, from the raised position shown in FIG. 3 into a lowered position, for cutting action against a length of tree or log.

The shaft 25 is mounted on the two fixed brackets 29, 30, attached for example to a cross beam or the ceiling of the building in which the apparatus is housed, and is axially movable on bearings 31, 32.

The shaft 32 has an axial keyway 33, engaging key pins (not shown) fixed in the bearings 31, 32, to prevent rotation of the shaft 25 in the bearings.

At one end of the shaft 25 is a lever arm 35, pivotably attached thereto. The lever arm is pivotably anchored by way of pivot pin 35*a* to brackets 35*b*, 35*c*, also attached for instance to a cross beam or the ceiling. The other end of the lever arm 35 is pivotably attached to the piston 34*a* of the hydraulic cylinder 34. Reciprocation of the piston 34*a* pivots the lever 35 on its pivot mounting 35*a*, and thus moves the shaft 25 axially, to the right or left. In this way the cutter 10 is moved transversely within its span of movement *d*. It is thus possible to locate the cutter in different transverse positions, according to the location of the cut to be made in the length of tree or log being transported along the conveyor 6.

The hydraulic cylinders 27, 34 are each actuated by way of switches or valves on a control panel 36, which can be operated manually, on the basis of visual observation, or automatically, according to computerized reports on the dimensions and quality of the logs. The dimensions of the logs can be determined automatically from signals from a number of photocells 37, which are arranged on a bracket support 37*a* above the one-piece feeder 5 (see FIG. 4). The photocells are adapted to sense the dimensions of the lengths of tree or logs passing below them, and to send signals to a computer 38, on the sides of the support 37*a*.

The computer 38 is adapted to receive the signals sent from the photocells 37, compare these with a predetermined wood yield program fed to the computer, and then, guided by this, to determine where the lengths of tree or logs have to be cut, to achieve the best yield. The computer can also be adapted alternatively to indicate its computations in the form of visually readable values, or, if the operator wants, automatically to forward the determination of the actuator control panel 36 in the form of signals. The actuator control panel 36 can receive the signals sent from the computer 38, and, in response thereto, adjust the transverse and vertical positioning of the cutters 7, 8, 9, 10, 11, 12, 13, 14 according to these reports. The adjustment of the cutters puts them in their proper cutting positions at the right time and is timed such that the cut is begun while the cutter is being lowered, and is complete by the time the cutter has reached its lowermost actuating position. The cutting is thus carried out during a downward movement of the cutter and a forward slightly upward (due to the incline of the conveyor) movement of the length of tree or log, which facilitates the cutting.

The spans *a*, *b*, *c*, *d* are arranged in the device shown in the drawings such that they extend over a distance of approximately 8 feet. Over this span, a number of positions are provided (not shown in the Figures), arranged at a spacing of 2 to 4 inches, providing a corresponding number of distinct cutting positions, to facilitate locating the cutters in certain positions when they are being moved transversely, along the shaft 25. The devices defining these positions are so placed that they do not interefere with movement of the conveyor 6.

The photocells 37 may sense and report any of the dimensions of the lengths or logs, including, for instance, the length, the maximum and minimum diameters, and the diameters along the central portions. Instead of photocells, it is also possible to use other sensing devices, such as pneumatic feeling devices.

The determination of the type of wood, the quality of the wood, and the presence of branches on the lengths or logs, is preferably carried out by an operator from the control cabin 39, while the speed of the logs is temporarily slowed as they are carried on the one-piece feeder 5. These records of course can also be carried out automatically, for example, by using X-ray equipment sensing the quality of the wood; a bark tester indicating the type of wood; and a supersonic instrument indicating the presence of branches on the lengths or logs, etc., according to known means. The record of the quality of the log can also be used to provide marks on the logs, indicating, for example, the quality, to facilitate the ensuing sorting operations.

After the length of tree or log has been cut into pieces on the conveyor 6, the pieces are sorted. Some sections are designated for pulping or other purposes, such as chips, while other sections are designated as saw timber, for lumber or planks. The cut pieces are fed from the conveyor 6 to the conveyors 15 and 16, in a manner to distribute the logs relatively evenly in number to each conveyor, for maximum capacity of the apparatus. The pieces of log are then transported in their longitudinal direction by the conveyors 15, 16 to the sensing devices 17.

As noted previously, these devices are adapted to sense the length and predetermined number of diameters of each log piece, and to compute additional properties, such as for example, the volume and taper of the pieces. A counter can be included, to make it possible to determine the volume and the taper of the wood pieces. The sensing device can also include a computer, connected to a number of deflector means 40, mounted in front of each sorting bay 19, and at the discharge end of the conveyor 20. The deflectors 40 are adapted to be activated by electrical signals sent from the computer, in response to the determination of the dimensions and quality of the wood pieces. The deflectors are activated in such a manner that each wood piece is automatically deflected into its particular sorting bay 19 or onto the conveyor 20, according to the signal given.

Figure 6:
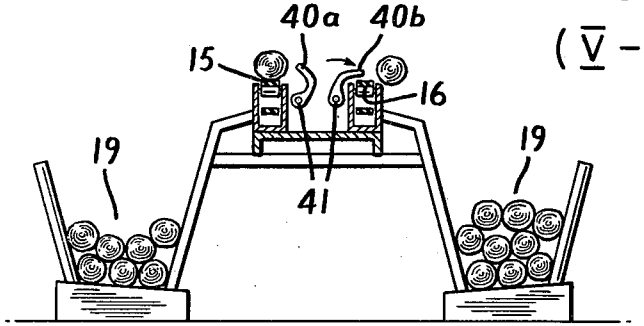
FIG. 6 is a vertical transverse section of the sorter taken along the lines V—V of FIG. 5.

As best seen in FIG. 6, each deflector 40 comprises an arcuate bar 40, pivotable about a shaft 41 extending between and parallel to the conveyors 15, 16 in front of the corresponding bays 19 or the conveyor 20. The deflectors are rotatable or pivotable between an inactive nondirecting position, and an active directing position, the lefthand deflector 40*a* of FIG. 6 being in an active nondirecting position, and the righthand deflector 40*b* in FIG. 6 being in an active directing position.

During its pivoting motion from the inactive position to the active position, each deflector 40 deflects the wood piece from the conveyor 15 or 16 by pushing it sideways, either into the sorting bay 19 reserved for this particular wood piece, according to the determination of the sensing device 17, or alternatively, to the conveyor 20.

The operation of the deflectors 40 is automatically synchronized with the length and conveying speed of the cut pieces of log, so that the ends of the deflectors 40 will strike the central portion of the piece of log to be deflected, thus thrusting it smartly into the selected bay 19, or onto the conveyor 20.

A number of modifications of the apparatus can be made.

The sensing device 17 can be replaced by manually-operated control means, controlled from the control cabin 39, and adapted to operate the deflectors 40. This makes it possible for the operator to decide according to his opinion and judgment the dimensions and qualities of the logs, and deflect them into a sorting bay 19 of his own selection, or to the conveyor 20. However, an automatic arrangement is preferable, to provide very exact choices, and also to make it possible to determine properties of the logs which cannot be evaluated visually.

The conveyor 20 can of course be arranged so as to transport the cut wood pieces to one or several plants for further processing, and similarly, the bays 19 can be replaced by conveyors, for the same purpose.

In the embodiment of the invention shown in the drawings, the conveyors 15, 16 are arranged in parallel, and in two sections, one extending from the conveyor 6 to the sensing device 17, and the other extending from the sensing device 17 to the last of the sorting bays 19. In order to sort the pieces of log on the conveyors 15, 16 one by one, it is necessary to keep them separated. This is carried out by operating the second conveyor portion, beyond the sensing devices 17, at a higher conveying speed than the first portion, before the sensing devices 17. Various speeds can be adopted, but in the device shown, preferred speeds are for the first portion 90 meters per minute, and for the second portion 94 meters per minute, but these speeds can of course be varied, as well as the difference between them.

It is also possible to have more than two cutters per paired group for each cutting zone, *a, b, c, d*, as shown. Thus, three, four or more cutters can be placed in each group along the conveyor 6, for operation in each zone *a, b, c, d*, spaced apart in two, three or more rows per group. It is important that the cutters in each group be spaced from each other, so that only one cutter engages a length of tree or log at one time in each group. Moreover, while the groups shown each have a span for action of approximately 8 feet, this can of course be either reduced or increased, and can for example range from 1 foot to approximately 20 feet. It will however, be appreciated that for greatest cutting efficiency of logs into small pieces, the spacing must of course be correspondingly small, while for cutting into large pieces, the spacing can be increased. Thus the spacing will depend upon the dimensions of the log pieces to be cut. Similarly, the positioning devices can be spaced as desired, according to the span of activity for each group of cutters.

In a similar modification of the invention, three or more successively arranged sloping conveyors can be used in place of the two conveyors 2, 3 shown in the drawings. This will ensure that jams of very crooked logs, such as for example birch, are completely separated before they reach the cutter conveyor 6.

The initial conveyor 1 can be an actuated roller conveyor, rather than a chain conveyor, and other types of conveyors can be substituted for 1, 2, 3 and 6, as desired.

The conveyor 1 may also comprise a pivotably mounted plate disposed at a height across the conveyor, to automatically regulate the height of the layers of tree lengths or logs transferred to the conveyor 2, thus precluding the transfer of tree lengths or logs which are too heavy, for example, or layers which are more than one tree length or log deep.

In still another modification of the invention, the cutters can be arranged so as to be moved downwards to an inactive position below the conveyor 6, and upwards to an active position along the conveying path.

In the preferred embodiment shown in the Figures, the cut pieces of log are transferred from one part of the conveyor 6 to the conveyor 16 by means of a one-piece feeder 18. This may be replaced by elongating that portion of the conveyor 6, so as to extend all the way to the conveyor 16.

Figure 7:
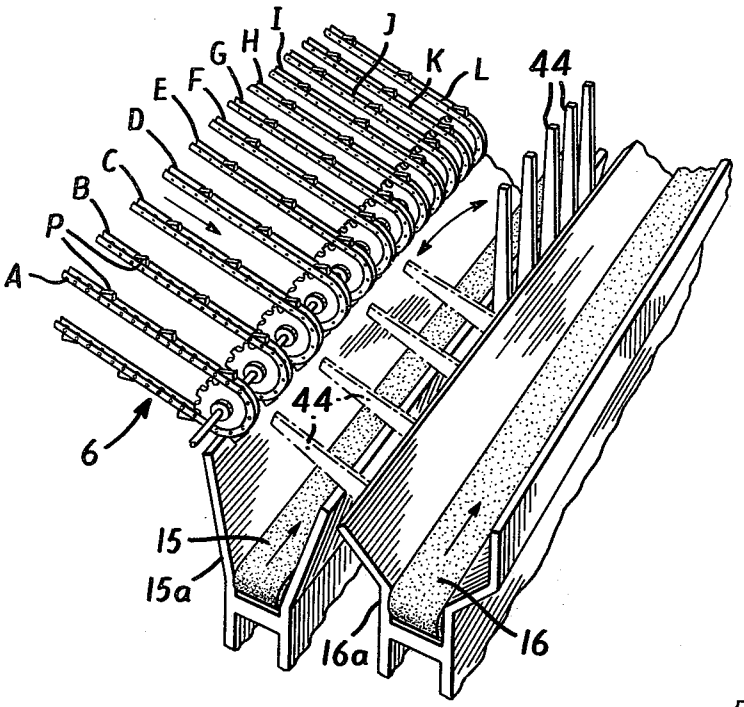
FIG. 7 shows a modification of the device of FIGS. 1 and 2, for conveying the cut log pieces from the cutters to the sorting area.

As a further modification, the belt conveyors 15, 16 may be of the same length, and arranged along the entire discharge end of the conveyor 6, as shown in FIG. 7. In this event, the frames 15*a*, 16*a* of the conveyors 15, 16 comprise a number of pivotably mounted guiding bars 44, adapted to be manually or automatically moved between lowered (shown in dashed lines)

and raised (shown in solid lines) positions. When raised, the cut log pieces are fed by conveyor 6 into conveyor 15. When lowered, the cut log pieces move across conveyor 15 and are fed into conveyor 16. A number of bars 44 are raised, and a number lowered, so as to distribute the cut wood pieces onto the conveyors 15, 16 so that approximately equal numbers of pieces are carried on each conveyor, to facilitate maintaining a high production rate.

To facilitate feeding the cut log pieces on to the conveyor 16, the guiding arms 44 may be balanced so as to be pivoted upwardly under the weight of a log resting thereon, and dump the log on the conveyor 16.

Having regard to the foregoing disclosure, the following is claimed as inventive and patentable embodiments thereof:

1. An apparatus for cutting lengths of trees or logs into shorter pieces, comprising in combination, a conveyor for carrying lengths of trees or logs sideways to and through a cutter; a cutter extending across the conveyor and comprising a plurality of cutting means movable between inactive noncutting and active cutting positions and between limiting positions along the length of a tree or log for cross-cutting the length at a selected position, the cutting means being arranged in groups, and spaced lengthwise in such groups along the length of the conveyor a distance such that only one cutting means in a group is in cutting engagement with a given length of tree or log at one time; means for arranging selected cutting means across the conveyor according to the selected cuts to be made in a length of tree or log; and means for collecting and delivering cut log pieces according to the desired end use.

2. An apparatus according to claim 1, including means for either automatically or visually determining the quality and/or dimensions of lengths of tree or logs, to determine what pieces are to be cut out, and where, for optimum utilization of the tree or log.

3. An apparatus according to claim 2 in which the means for arranging selected cutting means across the conveyor is responsive automatically to the means for determining what pieces are to be cut out, and where.

4. An apparatus according to claim 3 in which the means for determining what pieces are to be cut out, and where, comprises a plurality of photoelectric cells and a computer.

5. An apparatus according to claim 1, including means for classifying the log pieces according to quality and dimensions, for selecting the end use to which the log pieces are to be put, and for directing the cut log pieces as appropriate for sawing, pulping, chipping or other purposes.

6. An apparatus according to claim 1, including additional conveyors for carrying the cut log pieces from the cutters to the collecting and delivering means.

7. An apparatus according to claim 1, including at least one inclined feed conveyor before the cutters, for separating bundles or piles of the tree lengths or logs into single lengths, and conveying the lengths one at a time to the cutters.

8. An apparatus according to claim 1, in which the cutting means are arranged in at least two rows transversely across the conveyor, with at most one cutting means of each group in one such row.

9. An apparatus according to claim 1, in which the cutting means are pivotably mounted across the conveyor for movement between raised and lowered positions into and out of cutting engagement with the lengths.

10. An apparatus according to claim 1, in which the cutting means are rotatable circular saws.

11. An apparatus according to claim 1, in which the conveyors comprise endless means movable in a forward direction along the conveying path and carrying means for engaging and moving such lengths forward with the endless means.

12. An apparatus according to claim 1, comprising a plurality of feed conveyors arranged in series for carrying the lengths to and through the cutter, each conveyor in the series towards the cutters being movable at a higher forward speed than the preceding conveyor in the direction of the cutters to space the lengths for cutting.

* * * * *